US006254698B1

(12) United States Patent
Koo et al.

(10) Patent No.: US 6,254,698 B1
(45) **Date of Patent: *Jul. 3, 2001**

(54) ULTRA-HIGH STRENGTH AUSAGED STEELS WITH EXCELLENT CRYOGENIC TEMPERATURE TOUGHNESS AND METHOD OF MAKING THEREOF

(75) Inventors: Jayoung Koo, Bridgewater; Narasimha-Rao V. Bangaru, Annandale, both of NJ (US); Glen A. Vaughn, Houston, TX (US); Raghavan Ayer, Woodbridge, CT (US)

(73) Assignee: ExxonMobile Upstream Research Company, Houston, TX (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/215,773

(22) Filed: Dec. 19, 1998

Related U.S. Application Data

(63) Continuation-in-part of application No. 09/099,153, filed on Jun. 18, 1998.

(60) Provisional application No. 60/068,252, filed on Dec. 19, 1997.

(51) Int. Cl.[7] ..... C21D 8/02; C21D 7/13; C22C 38/08

(52) U.S. Cl. ..... 148/336; 148/332; 148/335; 148/654; 148/648

(58) Field of Search ..... 148/320, 654, 148/648, 336, 332, 330, 333, 334, 335

(56) References Cited

U.S. PATENT DOCUMENTS 4,878,955 11/1989 Hoshino et al. ..... 148/12

(List continued on next page.)

FOREIGN PATENT DOCUMENTS 59-013055 1/1984 (JP) .
63-062843 3/1988 (JP) .
7-331328 12/1995 (JP) .
8-176659(A) 7/1996 (JP) .

(List continued on next page.)

OTHER PUBLICATIONS

Reference cited by the Taiwan Patent Office in counterpart to parent application, reference title—"Manual of Forging Technology", Association of Industrial Technology Development of ROC, pp. 221–223 and pp. 231–233; English translations of relevant portions as provided by Applicant's agent in Taiwan, Jan. 1997.

(List continued on next page.)

*Primary Examiner*—Deborah Yee
(74) *Attorney, Agent, or Firm*—Marcy M. Hoefling

(57) ABSTRACT

An ultra-high strength, weldable, low alloy steel with excellent cryogenic temperature toughness in the base plate and in the heat affected zone (HAZ) when welded, having a tensile strength greater than about 830 MPa (120 ksi) and a microstructure comprising (i) predominantly fine-grained lower bainite, fine-grained lath martensite, fine granular bainite (FGB), or mixtures thereof, and (ii) up to about 10 vol % retained austenite, is prepared by heating a steel slab comprising iron and specified weight percentages of some or all of the additives carbon, manganese, nickel, nitrogen, copper, chromium, molybdenum, silicon, niobium, vanadium, titanium, aluminum, and boron; reducing the slab to form plate in one or more passes in a temperature range in which austenite recrystallizes; finish rolling the plate in one or more passes in a temperature range below the austenite recrystallization temperature and above the $Ar_3$ transformation temperature; quenching the finish rolled plate to a suitable Quench Stop Temperature (QST); stopping the quenching; and either, for a period of time, holding the plate substantially isothermally at the QST or slow-cooling the plate before air cooling, or simply air cooling the plate to ambient temperature.

29 Claims, 6 Drawing Sheets

U.S. PATENT DOCUMENTS

| | | | |
|---|---|---|---|
| 5,183,198 | 2/1993 | Tamehiro et al. | 228/186 |
| 5,454,883 | 10/1995 | Yoshie et al. | 148/320 |
| 5,531,842 | 7/1996 | Koo et al. | 148/654 |
| 5,545,269 | 8/1996 | Koo et al. | 148/654 |
| 5,545,270 | 8/1996 | Koo et al. | 148/654 |
| 5,653,826 | 8/1997 | Koo et al. | 148/328 |
| 5,755,895 | 5/1998 | Tamehiro et al. | 148/336 |
| 5,785,924 | 7/1998 | Beguinot et al. | 420/63 |
| 5,798,004 | 8/1998 | Tamehiro et al. | 148/336 |
| 5,900,075 | 5/1999 | Koo et al. | 148/328 |

FOREIGN PATENT DOCUMENTS

| | | |
|---|---|---|
| 8-295982(A) | 11/1996 | (JP) . |
| 9-235617 | 9/1997 | (JP) . |
| WO 9623083 | 8/1996 | (WO) . |

OTHER PUBLICATIONS

Reference cited by the Taiwan Patent Office in counterpart to parent application, reference title—"Journal of Mechanics, Monthly, 18$^{th}$ volume 3$^{rd}$ periodical" under section "Special Edition for Metal Material";, chapter "On line Accelerated cooling treatment for steel plate and the product thereby, Introduction of TMCP steel plate", pp. 254–260; English translations of relevant portions as provided by Applicant's agent in Taiwan, Mar. 1992.

ULTRA-HIGH STRENGTH AUSAGED STEELS WITH EXCELLENT CRYOGENIC TEMPERATURE TOUGHNESS AND METHOD OF MAKING THEREOF

This application is a continuation-in-part of U.S. application Ser. No. 09/099153, filed Jun. 18, 1998, now allowed which claims the benefit of U.S. Provisional Application No. 60/068,252, filed Dec. 19, 1997.

FIELD OF THE INVENTION

This invention relates to ultra-high strength, weldable, low alloy steel plates with excellent cryogenic temperature toughness in both the base plate and in the heat affected zone (HAZ) when welded. Furthermore, this invention relates to a method for producing such steel plates.

BACKGROUND OF THE INVENTION

Various terms are defined in the following specification. For convenience, a Glossary of terms is provided herein, immediately preceding the claims.

Frequently, there is a need to store and transport pressurized, volatile fluids at cryogenic temperatures, i.e., at temperatures lower than about −40° C. (−40° F.). For example, there is a need for containers for storing and transporting pressurized liquefied natural gas (PLNG) at a pressure in the broad range of about 1035 kPa (150 psia) to about 7590 kPa (1100 psia) and at a temperature in the range of about −123° C. (−190° F.) to about −62° C. (−80° F.). There is also a need for containers for safely and economically storing and transporting other volatile fluids with high vapor pressure, such as methane, ethane, and propane, at cryogenic temperatures. For such containers to be constructed of a welded steel, the steel must have adequate strength to withstand the fluid pressure and adequate toughness to prevent initiation of a fracture, i.e., a failure event, at the operating conditions, in both the base steel and in the HAZ.

The Ductile to Brittle Transition Temperature (DBTT) delineates the two fracture regimes in structural steels. At temperatures below the DBTT, failure in the steel tends to occur by low energy cleavage (brittle) fracture, while at temperatures above the DBTT, failure in the steel tends to occur by high energy ductile fracture. Welded steels used in the construction of storage and transportation containers for the aforementioned cryogenic temperature applications and for other load-bearing, cryogenic temperature service must have DBTTs well below the service temperature in both the base steel and the HAZ to avoid failure by low energy cleavage fracture.

Nickel-containing steels conventionally used for cryogenic temperature structural applications, e.g., steels with nickel contents of greater than about 3 wt %, have low DBTTs, but also have relatively low tensile strengths. Typically, commercially available 3.5 wt % Ni, 5.5 wt % Ni, and 9 wt % Ni steels have DBTTs of about −100° C. (−150° F.), −155° C. (−250° F.), and −175° C. (−280° F.), respectively, and tensile strengths of up to about 485 MPa (70 ksi), 620 MPa (90 ksi), and 830 MPa (120 ksi), respectively. In order to achieve these combinations of strength and toughness, these steels generally undergo costly processing, e.g., double annealing treatment. In the case of cryogenic temperature applications, industry currently uses these commercial nickel-containing steels because of their good toughness at low temperatures, but must design around their relatively low tensile strengths. The designs generally require excessive steel thicknesses for load-bearing, cryogenic temperature applications. Thus, use of these nickel-containing steels in load-bearing, cryogenic temperature applications tends to be expensive due to the high cost of the steel combined with the steel thicknesses required.

On the other hand, several commercially available, state-of-the-art, low and medium carbon high strength, low alloy (HSLA) steels, for example AISI 4320 or 4330 steels, have the potential to offer superior tensile strengths (e.g., greater than about 830 MPa (120 ksi)) and low cost, but suffer from relatively high DBTTs in general and especially in the weld heat affected zone (HAZ). Generally, with these steels there is a tendency for weldability and low temperature toughness to decrease as tensile strength increases. It is for this reason that currently commercially available, state-of-the-art HSLA steels are not generally considered for cryogenic temperature applications. The high DBTT of the HAZ in these steels is generally due to the formation of undesirable microstructures arising from the weld thermal cycles in the coarse grained and intercritically reheated HAZs, i.e., HAZs heated to a temperature of from about the $Ac_1$ transformation temperature to about the $Ac_3$ transformation temperature. (See Glossary for definitions of $Ac_1$ and $Ac_3$ transformation temperatures.). DBTT increases significantly with increasing grain size and embrittling microstructural constituents, such as martensite-austenite (MA) islands, in the HAZ. For example, the DBTT for the HAZ in a state-of-the-art HSLA steel, X100 linepipe for oil and gas transmission, is higher than about −50° C. (−60° F.). There are significant incentives in the energy storage and transportation sectors for the development of new steels that combine the low temperature toughness properties of the above-mentioned commercial nickel-containing steels with the high strength and low cost attributes of the HSLA steels, while also providing excellent weldability and the desired thick section capability, i.e., the ability to provide substantially the desired microstructure and properties (e.g., strength and toughness), particularly in thicknesses equal to or greater than about 25 mm (1 inch).

In non-cryogenic applications, most commercially available, state-of-the-art, low and medium carbon HSLA steels, due to their relatively low toughness at high strengths, are either designed at a fraction of their strengths or, alternatively, processed to lower strengths for attaining acceptable toughness. In engineering applications, these approaches lead to increased section thickness and therefore, higher component weights and ultimately higher costs than if the high strength potential of the HSLA steels could be fully utilized. In some critical applications, such as high performance gears, steels containing greater than about 3 wt % Ni (such as AISI 48XX, SAE 93XX, etc.) are used to maintain sufficient toughness. This approach leads to substantial cost penalties to access the superior strength of the HSLA steels. An additional problem encountered with use of standard commercial HSLA steels is hydrogen cracking in the HAZ, particularly when low heat input welding is used.

There are significant economic incentives and a definite engineering need for low cost enhancement of toughness at high and ultra-high strengths in low alloy steels. Particularly, there is a need for a reasonably priced steel that has ultra-high strength, e.g., tensile strength greater than about 830 MPa (120 ksi), and excellent cryogenic temperature toughness, e.g. DBTT lower than about −62° C. (−80° F.), both in the base plate when tested in the transverse direction (see Glossary for definition of transverse direction) and in the HAZ, for use in commercial cryogenic temperature applications.

Consequently, the primary objects of the present invention are to improve the state-of-the-art HSLA steel technology for applicability at cryogenic temperatures in three key areas: (i) lowering of the DBTT to less than about −62° C. (−80° F.) in the base steel in the transverse direction and in the weld HAZ, (ii) achieving tensile strength greater than about 830 MPa (120 ksi), and (iii) providing superior weldability. Other objects of the present invention are to achieve the aforementioned HSLA steels with thick section capability, preferably, for thicknesses equal to or greater than about 25 mm (1 inch) and to do so using current commercially available processing techniques so that use of these steels in commercial cryogenic temperature processes is economically feasible.

SUMMARY OF THE INVENTION

Consistent with the above-stated objects of the present invention, a processing methodology is provided wherein a low alloy steel slab of the desired chemistry is reheated to an appropriate temperature, then hot rolled to form steel plate and rapidly cooled, at the end of hot rolling, by quenching with a suitable fluid, such as water, to a suitable Quench Stop Temperature (QST), to produce a microstructure comprising (i) predominantly fine-grained lower bainite, fine-grained lath martensite, fine granular bainite (FGB), or mixtures thereof, and (ii) up to about 10 vol % retained austenite. The FGB of the present invention is an aggregate comprising bainitic ferrite as a major constituent (at least about 50 vol %) and particles of mixtures of martensite and retained austenite as minor constituents (less than about 50 vol %). As used in describing the present invention, and in the claims, "predominantly", "predominant" and "major" all mean at least about 50 volume percent, and "minor" means less than about 50 vol %.

Regarding the processing steps of this invention: In some embodiments, a suitable QST is ambient temperature. In other embodiments, a suitable QST is a temperature higher than ambient temperature, and quenching is followed by suitable slow cooling to ambient temperature, as described in greater detail hereinafter. In other embodiments, a suitable QST can be below ambient temperature. In one embodiment of this invention, following the quenching to a suitable QST, the steel plate is slow cooled by air cooling to ambient temperature. In another embodiment, the steel plate is held substantially isothermally at the QST for up to about five (5) minutes, followed by air cooling to ambient temperature. In yet another embodiment, the steel plate is slow-cooled at a rate lower than about 1.0° C. per second (1.8° F./sec) for up to about five (5) minutes, followed by air cooling to ambient temperature. As used in describing the present invention, quenching refers to accelerated cooling by any means whereby a fluid selected for its tendency to increase the cooling rate of the steel is utilized, as opposed to air cooling the steel to ambient temperature.

A steel slab processed according to this invention is manufactured in a customary fashion and, in one embodiment, comprises iron and the following alloying elements, preferably in the weight ranges indicated in the following Table I:

TABLE I

| Alloying Element | Range (wt %) |
|---|---|
| carbon (C) | 0.03–0.12, more preferably 0.03–0.07 |
| manganese (Mn) | up to 2.5, more preferably 0.5–2.5, and even more preferably 1.0–2.0 |
| nickel (Ni) | 1.0–3.0, more preferably 1.5–3.0 |

TABLE I-continued

| Alloying Element | Range (wt %) |
|---|---|
| copper (Cu) | up to about 1.0, more preferably 0.1–1.0, and even more preferably 0.2–0.5 |
| molybdenum (Mo) | up to about 0.8, more preferably 0.1–0.8, and even more preferably 0.2–0.4 |
| niobium (Nb) | 0.01–0.1, more preferably 0.02–0.05 |
| titanium (Ti) | 0.008–0.03, more preferably 0.01–0.02 |
| aluminum (Al) | up to about 0.05, more preferably 0.001–0.05, and even more preferably 0.005–0.03 |
| nitrogen (N) | 0.001–0.005, more preferably 0.002–0.003 |

Chromium (Cr) is sometimes added to the steel, preferably up to about 1.0 wt %, and more preferably about 0.2 wt % to about 0.6 wt %.

Silicon (Si) is sometimes added to the steel, preferably up to about 0.5 wt %, more preferably about 0.01 wt % to about 0.5 wt %, and even more preferably about 0.05 wt % to about 0.1 wt %.

The steel preferably contains at least about 1 wt % nickel. Nickel content of the steel can be increased above about 3 wt % if desired to enhance performance after welding. Each 1 wt % addition of nickel is expected to lower the DBTT of the steel by about 10° C. (18° F.). Nickel content is preferably less than 9 wt %, more preferably less than about 6 wt %. Nickel content is preferably minimized in order to minimize cost of the steel. If nickel content is increased above about 3 wt %, manganese content can be decreased below about 0.5 wt % down to 0.0 wt %.

Boron (B) is sometimes added to the steel, preferably up to about 0.0020 wt %, and more preferably about 0.0006 wt % to about 0.0015 wt %.

Additionally, residuals are preferably substantially minimized in the steel. Phosphorous (P) content is preferably less than about 0.01 wt %. Sulfur (S) content is preferably less than about 0.004 wt %. Oxygen (O) content is preferably less than about 0.002 wt %.

The specific microstructure obtained in this invention is dependent upon both the chemical composition of the low alloy steel slab that is processed and the actual processing steps that are followed in processing the steel. For example, without hereby limiting this invention, some specific microstructures that are obtained are as follows. In one embodiment, a predominantly micro-laminate microstructure comprising fine-grained lath martensite, fine-grained lower bainite, or mixtures thereof, and up to about 10 vol % retained austenite film layers, preferably about 1 vol % to about 5 vol % retained austenite film layers, is produced . The other constituents in this embodiment comprise fine granular bainite (FGB), polygonal ferrite (PF), deformed ferrite (DF), acicular ferrite (AF), upper bainite (UB), degenerate upper bainite (DUB) and the like, all as are familiar to those skilled in the art. This embodiment generally provides tensile strengths exceeding about 930 MPa (135 ksi). In yet another embodiment of this invention, following quenching to a suitable QST and the subsequent suitable slow cooling to ambient temperature, the steel plate has a microstructure comprising predominantly FGB. The other constituents that comprise the microstructure may include fine-grained lath martensite, fine-grained lower bainite, retained austenite (RA), PF, DF, AF, UB, DUB and the like. This embodiment generally provides tensile strengths in the lower range of this invention, i.e., tensile strengths of about 830 MPa (120 ksi) or more. As is discussed in greater detail herein, the value of $N_C$, a factor defined by the chemistry of the steel (as further discussed herein and in the Glossary), also impacts the strength and thick section capability, as well as the microstructure, of steels according to this invention.

Also, consistent with the above-stated objects of the present invention, steels processed according to the present invention are especially suitable for many cryogenic temperature applications in that the steels have the following characteristics, preferably, without thereby limiting this invention, for steel plate thicknesses of about 25 mm (1 inch) and greater: (i) DBTT lower than about −62° C. (−80° F.), preferably lower than about −73° C. (−100° F.), more preferably lower than about −100° C. (−150° F.) and even more preferably lower than about −123° C. (−190° F.) in the base steel in the transverse direction and in the weld HAZ, (ii) tensile strength greater than about 830 MPa (120 ksi), preferably greater than about 860 MPa (125 ksi), more preferably greater than about 900 MPa (130 ksi) and even more preferably greater than about 1000 MPa (145 ksi), (iii) superior weldability, and (iv) improved toughness over standard, commercially available, HSLA steels.

DESCRIPTION OF THE DRAWINGS

The advantages of the present invention will be better understood by referring to the following detailed description and the attached drawings in which.

While the present invention will be described in connection with its preferred embodiments, it will be understood that the invention is not limited thereto. On the contrary, the invention is intended to cover all alternatives, modifications, and equivalents which may be included within the spirit and scope of the invention, as defined by the appended claims.

DETAILED DESCRIPTION OF THE INVENTION

The present invention relates to the development of new HSLA steels meeting the above-described challenges. The invention is based on a novel combination of steel chemistry and processing for providing both intrinsic and microstructural toughening to lower DBTT as well as to enhance toughness at high tensile strengths. Intrinsic toughening is achieved by the judicious balance of critical alloying elements in the steel, as described in detail in this specification. Microstructural toughening results from achieving a very fine effective grain size as well as promoting micro-laminate microstructure.

Figure 3A:
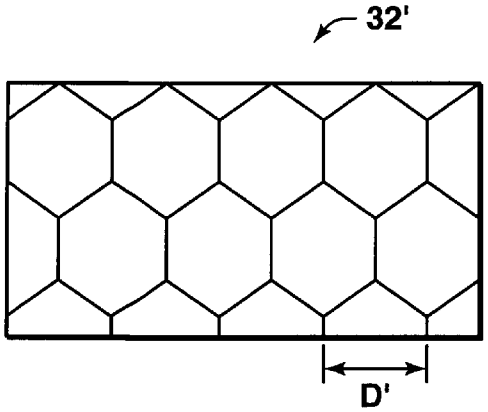
FIG. 3A is a schematic illustration of austenite grain size in a steel slab after reheating according to the present invention.
Figure 3B:
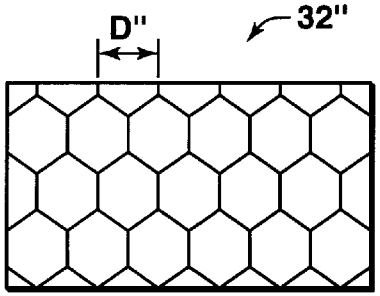
FIG. 3B is a schematic illustration of prior austenite grain size (see Glossary) in a steel slab after hot rolling in the temperature range in which austenite recrystallizes, but prior to hot rolling in the temperature range in which austenite does not recrystallize, according to the present invention.
Figure 3C:
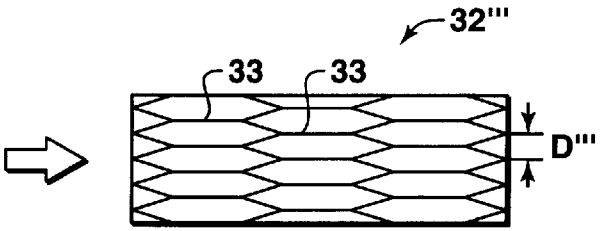
FIG. 3C is a schematic illustration of the elongated, pancake structure in austenite, with very fine effective grain size in the through-thickness direction, of a steel plate upon completion of rolling in TMCP according to the present invention.

Fine effective grain size is accomplished in two ways in the present invention. First, thermo-mechanical controlled rolling processing ("TMCP"), as described in detail in the following, is used to establish fine pancake structure in austenite at the end of rolling in the TMCP processing. This is an important first step in the overall refinement of microstructure in the present invention. Second, further refinement of austenite pancakes is achieved through transformation of the austenite pancakes to packets of micro-laminate structure, FGB, or mixtures thereof. As used in describing this invention, "effective grain size" refers to mean austenite pancake thickness upon completion of rolling in the TMCP according to this invention and to mean packet width or mean grain size upon completion of transformation of the austenite pancakes to packets of micro-laminate structure or FGB, respectively. As is further discussed below, D''' on FIG. 3C, illustrates austenite pancake thickness upon completion of rolling in TMCP processing according to this invention. Packets form inside of the austenite pancakes. Packet width is not illustrated in the drawings. This integrated approach provides for a very fine effective grain size, especially in the through-thickness direction of a steel plate according to this invention.

Figure 2C:
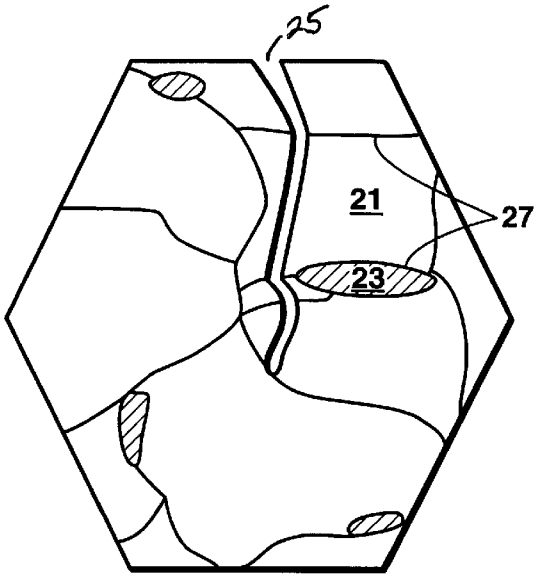
FIG. 2C is a schematic illustration showing a tortuous crack path in the FGB microstructure in a steel according to the present invention.
Figure 2B:
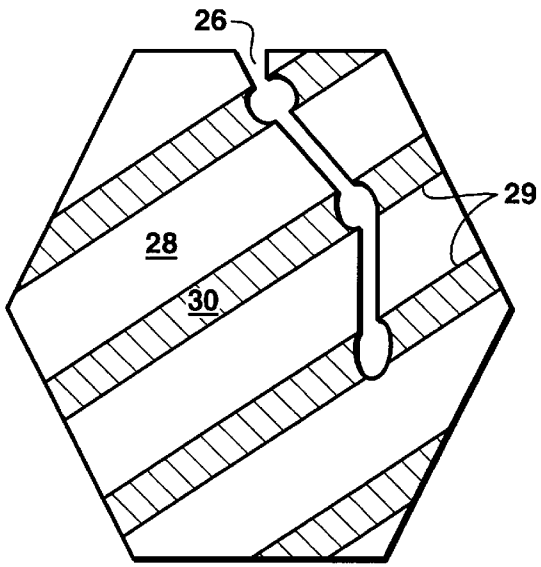
FIG. 2B is a schematic illustration showing a tortuous crack path due to the presence of the retained austenite phase in the micro-laminate microstructure in a steel according to the present invention.

Referring now to FIG. 2B, in a steel having a predominantly micro-laminate microstructure according to this invention, the predominantly micro-laminate microstructure is comprised of alternating laths 28, of either fine-grained lower bainite or fine-grained lath martensite or mixtures thereof, and retained austenite film layers 30. Preferably, the average thickness of the retained austenite film layers 30 is less than about 10% of the average thickness of the laths 28. Even more preferably, the average thickness of the retained austenite film layers 30 is less than about 10 nm and the average thickness of the laths 28 is about 0.2 microns. Fine-grained lath martensite and fine-grained lower bainite occur in packets within the austenite pancakes consisting of several similarly oriented laths. Typically, there is more than one packet within a pancake and a packet itself is made up of about 5 to 8 laths. Adjacent packets are separated by high angle boundaries. The packet width is the effective grain size in these structures and it has a significant effect on the cleavage fracture resistance and the DBTT, with finer packet widths providing lower DBTT. In the present invention, the preferred mean packet width is less than about 5 microns, and more preferably, less than about 3 microns and even more preferably less than about 2 microns. (See Glossary for definition of "high angle boundary".) Referring now to FIG. 2C, the FGB microstructure, which can be either a predominant or a minor constituent in the steels of the present invention, is schematically depicted. The FGB of the present invention is an aggregate comprising bainitic ferrite 21 as a major constituent and particles of mixtures of martensite and retained austenite 23 as minor constituents. The FGB of the present invention has a very fine grain size mimicking the mean packet width of the fine-grained lath martensite and fine-grained lower bainite microstructure described above. The FGB can form during the quenching to the QST and/or during the isothermal holding at QST and/or slow cooling from the QST in the steels of the present invention, especially at the center of a thick, ≧25 mm, plate when the total alloying in the steel is low and/or if the steel does not have sufficient "effective" boron, that is, boron that is not tied up in oxide and/or nitride. In these instances, and depending on the cooling rate for the quenching and the overall plate chemistry, FGB may form either as a minor or as a predominant constituent. In the present invention, the preferred mean grain size of the FGB is less than about 3 microns, more preferably less than about 2 microns, even more preferably less than about 1 micron. Adjacent grains of the bainitic ferrite 21 form high angle boundaries 27 in which the grain boundary separates two adjacent grains whose crystallographic orientations differ typically by more than about 15°, whereby these boundaries are quite effective for crack deflection and in enhancing crack tortuosity. (See Glossary for definition of "high angle boundary".) In the FGB of the present invention the martensite is preferably of a low carbon (≦0.4 wt %), dislocated type with little or no twinning and contains dispersed retained austenite. This martensite/retained austenite is beneficial to toughness and DBTT. The vol % of these minor constituents in the FGB of the present invention can vary depending on the steel composition and processing but is preferably less than about 40 vol %, more preferably less than about 20 vol %, and even more preferably less than about 10% of the FGB. The martensite/retained austenite particles of FGB are effective in providing additional crack deflection and tortuosity within the FGB, similar to that explained above for the micro-laminate microstructure embodiment. The strength of FGB of the present invention, estimated to be about 690 to 760 MPa (100 to 110 ksi), is significantly lower than that of fine-grained lath martensite or fine-grained lower bainite, which can be, depending on the carbon content of the steel, greater than about 930 MPa (135 ksi). It has been found in this invention that, for carbon contents in the steel of about 0.030 wt % to about 0.065 wt %, the amount of FGB (averaged over the thickness) in the microstructure is preferably limited to less than about 40 vol % in order for the strength of the plate exceed about 930 MPa (135 ksi).

Figure 1A:
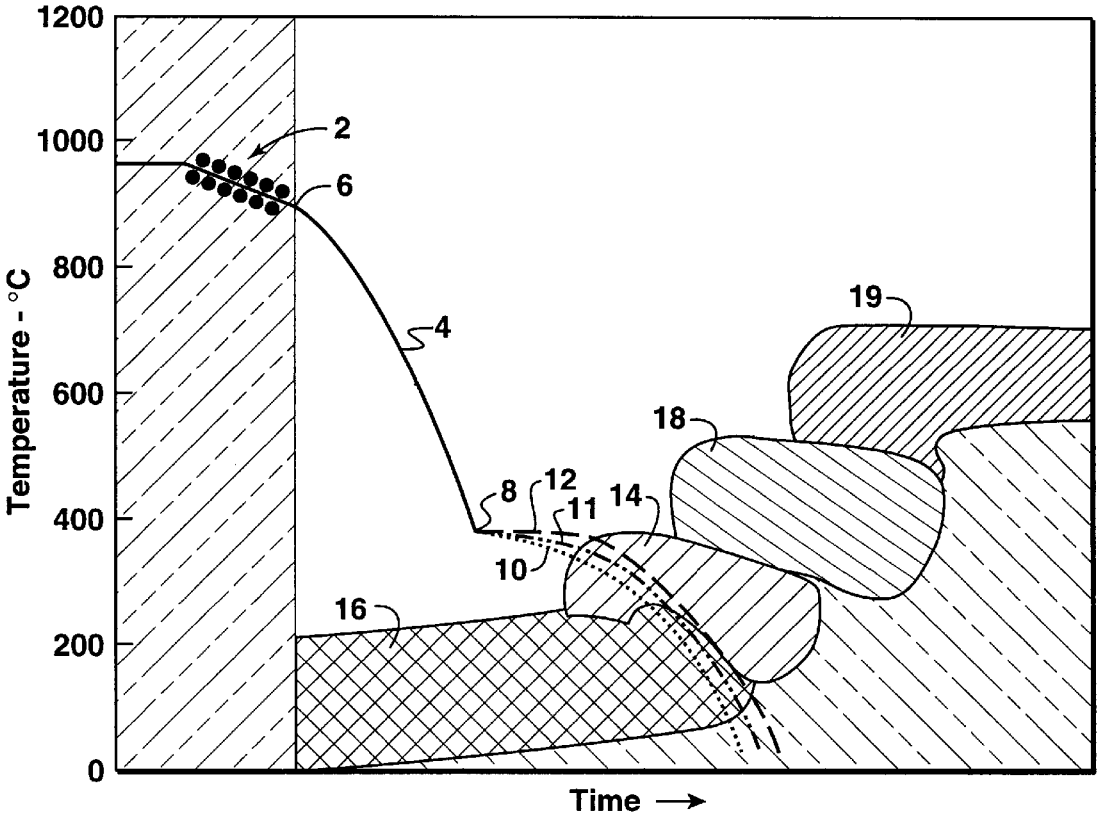
FIG. 1A is a schematic continuous cooling transformation (CCT) diagram showing how the ausaging process of the present invention produces micro-laminate microstructure in a steel according to the present invention.
Figure 1B:
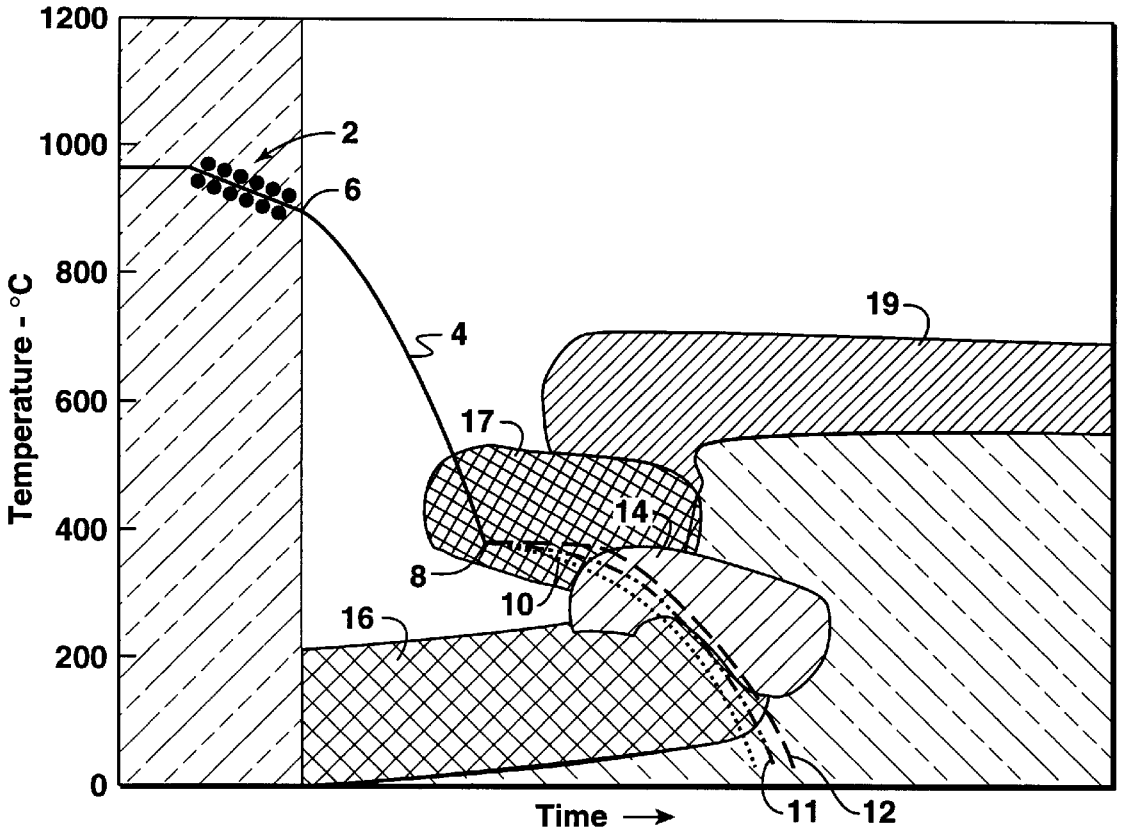
FIG. 1B is a schematic continuous cooling transformation (CCT) diagram showing how the ausaging process of the present invention produces FGB microstructure in a steel according to the present invention.

Ausaging is used in the present invention to facilitate formation of the micro-laminate microstructure by promoting retention of the desired retained austenite film layers at ambient temperatures. As is familiar to those skilled in the art, ausaging is a process wherein aging of austenite is enhanced by suitable thermal treatments prior to its transformation to lower bainite and/or martensite. In the present invention, quenching the steel plate to a suitable QST, followed by slow cooling in ambient air, or via the other slow cooling means described above, to ambient temperature, is used to promote ausaging. It is known in the art that ausaging promotes thermal stabilization of austenite which in turn leads to the retention of austenite when the steel is subsequently cooled down to ambient and low temperatures. The unique steel chemistry and processing combination of this invention provides for a sufficient delay time in the start of the bainite transformation after quenching is stopped to allow for adequate aging of the austenite for retention of the austenite film layers in the micro-laminate microstructure. For example, referring now to FIG. 1A, one embodiment of a steel processed according to this invention undergoes controlled rolling 2 within the temperature ranges indicated (as described in greater detail hereinafter); then the steel undergoes quenching 4 from the start quench point 6 until the stop quench point (i.e., QST) 8. After quenching is stopped at the stop quench point (QST) 8, (i) in one embodiment, the steel plate is held substantially isothermally at the QST for a period of time, preferably up to about 5 minutes, and then air cooled to ambient temperature, as illustrated by the dashed line 12, (ii) in another embodiment, the steel plate is slow cooled from the QST at a rate lower than about 1.0° C. per second (1.8° F./sec) for up to about 5 minutes, prior to allowing the steel plate to air cool to ambient temperature, as illustrated by the dash-dot-dot line 11, (iii) in still another embodiment, the steel plate may be allowed to air cool to ambient temperature, as illustrated by the dotted line 10. In any of the different processing embodiments, austenite film layers are retained after formation of lower bainite laths in the lower bainite region 14 and martensite laths in the martensite region 16. The upper bainite region 18 and ferrite/pearlite region 19 are preferably substantially minimized or avoided. Referring now to FIG. 1B, another embodiment of a steel processed according to this invention, i.e., a steel of a different chemistry than the steel whose processing is represented in FIG. 1A, undergoes controlled rolling 2 within the temperature ranges indicated (as described in greater detail hereinafter); then the steel undergoes quenching 4 from the start quench point 6 until the stop quench point (i.e., QST) 8. After quenching is stopped at the stop quench point (QST) 8, (i) in one embodiment, the steel plate is held substantially isothermally at the QST for a period of time, preferably up to about 5 minutes, and then air cooled to ambient temperature, as illustrated by the dashed line 12, (ii) in another embodiment, the steel plate is slow cooled from the QST at a rate lower than about 1.0° C. per second (1.8° F./sec) for up to about 5 minutes, prior to allowing the steel plate to air cool to ambient temperature, as illustrated by the dash-dot-dot line 11, (iii) in still another embodiment, the steel plate may be allowed to air cool to ambient temperature, as illustrated by the dotted line 10. In any of the embodiments, FGB forms in FGB region 17 before formation of lower bainite laths in the lower bainite region 14 and martensite laths in the martensite region 16. The upper bainite region (not shown in FIG. 1B) and ferrite/pearlite region 19 are preferably substantially minimized or avoided. In the steels of the present invention, enhanced ausaging occurs due to the novel combination of steel chemistry and processing described in this specification.

The bainite and martensite constituents and the retained austenite phase of the micro-laminate microstructure are designed to exploit the superior strength attributes of fine-grained lower bainite and fine-grained lath martensite, and the superior cleavage fracture resistance of retained austenite. The micro-laminate microstructure is optimized to substantially maximize tortuosity in the crack path, thereby enhancing the crack propagation resistance to provide significant microstructural toughening.

The minor constituents in the FGB of the present invention, viz., martensite/retained austenite particles, act much the same way as described above in reference to the micro-laminate structure to provide enhanced crack propagation resistance. In addition, in the FGB, the bainitic ferrite/bainitic ferrite interfaces and the martensite-retained austenite particle /bainitic ferrite interfaces are high angle boundaries which are very effective in enhancing crack tortuosity and thereby crack propagation resistance.

In accordance with the foregoing, a method is provided for preparing an ultra-high strength, steel plate having a microstructure comprising predominantly fine-grained lath martensite, fine-grained lower bainite, FGB or mixtures thereof, said method comprising the steps of: (a) heating a steel slab to a reheating temperature sufficiently high to (i) substantially homogenize the steel slab, (ii) dissolve substantially all carbides and carbonitrides of niobium and vanadium in the steel slab, and (iii) establish fine initial austenite grains in the steel slab; (b) reducing the steel slab to form steel plate in one or more hot rolling passes in a first temperature range in which austenite recrystallizes; (c) further reducing the steel plate in one or more hot rolling passes in a second temperature range below about the $T_{nr}$ temperature and above about the $Ar_3$ transformation temperature; (d) quenching the steel plate at a cooling rate of at least about 10° C. per second (18° F./sec) to a Quench Stop Temperature (QST) below about 550° C. (1022° F.), and preferably above about 100° C. (212° F.), and even more preferably below about the $M_S$ transformation temperature plus 100° C. (180° F.) and above about the $M_S$ transformation temperature, and (e) stopping said quenching. The QST can also be below the $M_S$ transformation temperature. In this case, the ausaging phenomenon as described above is still applicable to the austenite that is remaining after its partial transformation to martensite at the QST. In other cases, the QST can be ambient temperature or below in which case some ausaging can still occur during the quenching to this QST. In one embodiment, the method of this invention further comprises the step of allowing the steel plate to air cool to ambient temperature from the QST. In another embodiment, the method of this invention further comprises the step of holding the steel plate substantially isothermally at the QST for up to about 5 minutes prior to allowing the steel plate to air cool to ambient temperature. In yet another embodiment, the method of this invention further comprises the step of slow-cooling the steel plate from the QST at a rate lower than about 1.0° C. per second (1.8° F./sec) for up to about 5 minutes prior to allowing the steel plate to air cool to ambient temperature. This processing facilitates transformation of the steel plate to a microstructure of predominantly fine-grained lath martensite, fine-grained lower bainite, FGB or mixtures thereof. (See Glossary for definitions of $T_{nr}$ temperature, and of $Ar_3$ and $M_S$ transformation temperatures.)

To ensure high strength of greater than about 930 MPa (135 ksi) and ambient and cryogenic temperature toughness, steels according to this invention preferably have a predominantly micro-laminate microstructure comprising fine-grained lower bainite, fine-grained lath martensite, or mixtures thereof, and up to about 10 volume % retained austenite film layers. More preferably, the microstructure comprises at least about 60 volume percent to about 80 volume percent fine-grained lower bainite, fine-grained lath martensite or mixtures thereof. Even more preferably, the microstructure comprises at least about 90 volume percent fine-grained lower bainite, fine-grained lath martensite, or mixtures thereof. The remainder of the microstructure can comprise retained austenite (RA), FGB, PF, DF, AF, UB, DUB, and the like. For lower strengths, i.e., less than about 930 MPa (135 ksi) but higher than about 830 MPa (120 ksi), the steel may have a microstructure comprising predominantly FGB. The remainder of the microstructure can comprise fine-grained lower bainite, fine-grained lath martensite, RA, PF, DF, AF, UB, DUB, and the like. It is preferable to substantially minimize (to less than about 10 vol %, more preferably less than about 5 vol % of the microstructure) the formation of embrittling constituents such as UB, twinned martensite and MA in the steels of the present invention.

One embodiment of this invention includes a method for preparing a steel plate having a micro-laminate microstructure comprising about 2 vol % to about 10 vol % of austenite film layers and about 90 vol % to about 98 vol % laths of predominantly fine-grained martensite and fine-grained lower bainite, said method comprising the steps of: (a) heating a steel slab to a reheating temperature sufficiently high to (i) substantially homogenize said steel slab, (ii) dissolve substantially all carbides and carbonitrides of niobium and vanadium in said steel slab, and (iii) establish fine initial austenite grains in said steel slab; (b) reducing said steel slab to form steel plate in one or more hot rolling passes in a first temperature range in which austenite recrystallizes; (c) further reducing said steel plate in one or more hot rolling passes in a second temperature range below about the $T_{nr}$ temperature and above about the $Ar_3$ transformation temperature; (d) quenching said steel plate at a cooling rate of about 10° C. per second to about 40° C. per second (18° F./sec–72° F./sec) to a Quench Stop Temperature below about the $M_S$ transformation temperature plus 100° C. (180° C.) and above about the $M_S$ transformation temperature; and (e) stopping said quenching, said steps being performed so as to facilitate transformation of said steel plate to a micro-laminate microstructure of about 2 vol % to about 10 vol % of austenite film layers and about 90 vol % to about 98 vol % laths of predominantly fine-grained martensite and fine-grained lower bainite.

Processing of the Steel Slab

(1) Lowering of DBTT

Achieving a low DBTT, e.g., lower than about −62° C. (−80° F.), in the transverse direction of the base plate and in the HAZ, is a key challenge in the development of new HSLA steels for cryogenic temperature applications. The technical challenge is to maintain/increase the strength in the present HSLA technology while lowering the DBTT, especially in the HAZ. The present invention utilizes a combination of alloying and processing to alter both the intrinsic as well as microstructural contributions to fracture resistance in a way to produce a low alloy steel with excellent cryogenic temperature properties in the base plate and in the HAZ, as hereinafter described.

In this invention, microstructural toughening is exploited for lowering the base steel DBTT. This microstructural toughening consists of refining prior austenite grain size, modifying the grain morphology through thermo-mechanical controlled rolling processing (TMCP), and producing a micro-laminate and/or a fine granular bainite (FGB) microstructure within the fine grains, all aimed at enhancing the interfacial area of the high angle boundaries per unit volume in the steel plate. As is familiar to those skilled in the art, "grain" as used herein means an individual crystal in a polycrystalline material, and "grain boundary" as used herein means a narrow zone in a metal corresponding to the transition from one crystallographic orientation to another, thus separating one grain from another. As used herein, a "high angle grain boundary" is a grain boundary that separates two adjacent grains whose crystallographic orientations differ by more than about 8°. Also, as used herein, a "high angle boundary or interface" is a boundary or interface that effectively behaves as a high angle grain boundary, i.e., tends to deflect a propagating crack or fracture and, thus, induces tortuosity in a fracture path.

The contribution from TMCP to the total interfacial area of the high angle boundaries per unit volume, Sv, is defined by the following equation:

$$Sv = \frac{1}{d}\left(1 + R + \frac{1}{R}\right) + 0.63(r - 30)$$

It is well known in the art that as the Sv of a steel increases, the DBTT decreases, due to crack deflection and the attendant tortuosity in the fracture path at the high angle boundaries. In commercial TMCP practice, the value of R is fixed for a given plate thickness and the upper limit for the value of r is typically 75. Given fixed values for R and r, Sv can only be substantially increased by decreasing d, as evident from the above equation. To decrease d in steels according to the present invention, Ti—Nb microalloying is used in combination with optimized TMCP practice. For the same total amount of reduction during hot rolling/deformation, a steel with an initially finer average austenite grain size will result in a finer finished average austenite grain size. Therefore, in this invention the amount of Ti—Nb additions are optimized for low reheating practice while producing the desired austenite grain growth inhibition during TMCP. Referring to FIG. 3A, a relatively low reheating temperature, preferably between about 955° C. and about 1100° C. (1750° F.–2012° F.), is used to obtain initially an average austenite grain size D' of less than about 120 microns in reheated steel slab 32' before hot deformation. Processing according to this invention avoids the excessive austenite grain growth that results from the use of higher reheating temperatures, i.e., greater than about 1100° C. (2012° F.), in conventional TMCP. To promote dynamic recrystallization induced grain refining, heavy per pass reductions greater than about 10% are employed during hot rolling in the temperature range in which austenite recrystallizes. Referring now to FIG. 3B, processing according to this invention provides an average prior austenite grain size D" (i.e., d) of less than about 50 microns, preferably less than about 30 microns, more preferably less than about 20 microns, and even more preferably less than about 10 microns, in steel slab 32" after hot rolling (deformation) in the temperature range in which austenite recrystallizes, but prior to hot rolling in the temperature range in which austenite does not recrystallize. Additionally, to produce an effective grain size reduction in the through-thickness direction, heavy reductions, preferably exceeding about 70% cumulative, are carried out in the temperature range below about the $T_{nr}$ temperature but above about the $Ar_3$ transformation temperature. Referring now to FIG. 3C, TMCP according to this invention leads to the formation of an elongated, pancake structure in austenite in a finish rolled steel plate 32'" with very fine effective grain size D'" in the through-thickness direction, e.g., effective grain size D'" less than about 10 microns, preferably less than about 8 microns, and even more preferably less than about 5 microns, and yet more preferably less than about 3 microns, thus enhancing the interfacial area of high angle boundaries, e.g. 33, per unit volume in steel plate 32'", as will be understood by those skilled in the art. (See Glossary for definition of "through-thickness direction".)

To minimize anisotropy in mechanical properties in general and to enhance the toughness and DBTT in the transverse direction, it is helpful to minimize the austenite pancake aspect ratio, that is, the mean ratio of pancake length to pancake thickness. In the present invention through the control of the TMCP parameters as described above, the aspect ratio for the pancakes is kept preferably less than about 100, more preferably less than about 75, even more preferably less than about 50, and yet even more preferably less than about 25.

In somewhat greater detail, a steel according to this invention is prepared by forming a slab of the desired composition as described herein; heating the slab to a temperature of from about 955° C. to about 100° C. (1750° F.–2012° F.), preferably from about 955° C. to about 1065° C. (1750° F.–1950° F.); hot rolling the slab to form steel plate in one or more passes providing about 30 percent to about 70 percent reduction in a first temperature range in which austenite recrystallizes, i.e., above about the $T_{nr}$ temperature, and further hot rolling the steel plate in one or more passes providing about 40 percent to about 80 percent reduction in a second temperature range below about the $T_{nr}$ temperature and above about the $Ar_3$ transformation temperature. The hot rolled steel plate is then quenched at a cooling rate of at least about 10° C. per second (18° F./sec) to a suitable QST below about 550° C. (1022° F.), at which time the quenching is terminated. The cooling rate for the quenching step is preferably faster than about 10° C. per second (18° F./sec) and even more preferably faster than about 20° C. per second (36° F./sec). Without hereby limiting this invention, the cooling rate in one embodiment of this invention is about 10° C. per second to about 40° C. per second (18° F./sec–72° F./sec). In one embodiment of this invention, after quenching is terminated the steel plate is allowed to air cool to ambient temperature from the QST, as illustrated by the dotted lines 10 of FIG. 1A and in FIG. 1B. In another embodiment of this invention, after quenching is terminated the steel plate is held substantially isothermally at the QST for a period of time, preferably up to about 5 minutes, and then air cooled to ambient temperature, as illustrated by the dashed lines 12 of FIG. 1A and FIG. 1B. In yet another embodiment as illustrated by the dash-dot-dot lines 11 of FIG. 1A and FIG. 1B, the steel plate is slow-cooled from the QST at a rate slower than that of air cooling, i.e., at a rate lower than about 1° C. per second (1.8° F./sec), preferably for up to about 5 minutes.

The steel plate may be held substantially isothermally at the QST by any suitable means, as are known to those skilled in the art, such as by placing a thermal blanket over the steel plate. The steel plate may be slow-cooled at a rate lower than about 1° C./sec (1.8° F./sec) after quenching is terminated by any suitable means, as are known to those skilled in the art, such as by placing an insulating blanket over the steel plate.

As is understood by those skilled in the art, as used herein percent reduction in thickness refers to percent reduction in the thickness of the steel slab or plate prior to the reduction referenced. For purposes of explanation only, without thereby limiting this invention, a steel slab of about 254 mm (10 inches) thickness may be reduced about 50% (a 50 percent reduction), in a first temperature range, to a thickness of about 127 mm (5 inches) then reduced about 80% (an 80 percent reduction), in a second temperature range, to a thickness of about 25 mm (1 inch). As used herein, "slab" means a piece of steel having any dimensions.

The steel slab is preferably heated by a suitable means for raising the temperature of substantially the entire slab, preferably the entire slab, to the desired reheating temperature, e.g., by placing the slab in a furnace for a period of time. The specific reheating temperature that should be used for any steel composition within the range of the present invention may be readily determined by a person skilled in the art, either by experiment or by calculation using suitable models. Additionally, the furnace temperature and reheating time necessary to raise the temperature of substantially the entire slab, preferably the entire slab, to the desired reheating temperature may be readily determined by a person skilled in the art by reference to standard industry publications.

Except for the reheating temperature, which applies to substantially the entire slab, subsequent temperatures referenced in describing the processing method of this invention are temperatures measured at the surface of the steel. The surface temperature of steel can be measured by use of an optical pyrometer, for example, or by any other device suitable for measuring the surface temperature of steel. The cooling rates referred to herein are those at the center, or substantially at the center, of the plate thickness; and the Quench Stop Temperature (QST) is the highest, or substantially the highest, temperature reached at the surface of the plate, after quenching is stopped, because of heat transmitted from the mid-thickness of the plate. For example, during processing of experimental heats of a steel composition according to this invention, a thermocouple is placed at the center, or substantially at the center, of the steel plate thickness for center temperature measurement, while the surface temperature is measured by use of an optical pyrometer. A correlation between center temperature and surface temperature is developed for use during subsequent processing of the same, or substantially the same, steel composition, such that center temperature may be determined via direct measurement of surface temperature. Also, the required temperature and flow rate of the quenching fluid to accomplish the desired accelerated cooling rate may be determined by one skilled in the art by reference to standard industry publications.

For any steel composition within the range of the present invention, the temperature that defines the boundary between the recrystallization range and non-recrystallization range, the $T_{nr}$ temperature, depends on the chemistry of the steel, particularly the carbon concentration and the niobium concentration, on the reheating temperature before rolling, and on the amount of reduction given in the rolling passes. Persons skilled in the art may determine this temperature for a particular steel according to this invention either by experiment or by model calculation. Similarly, the $Ar_3$ and $M_S$ transformation temperatures referenced herein may be determined by persons skilled in the art for any steel according to this invention either by experiment or by model calculation.

Figure 2A:
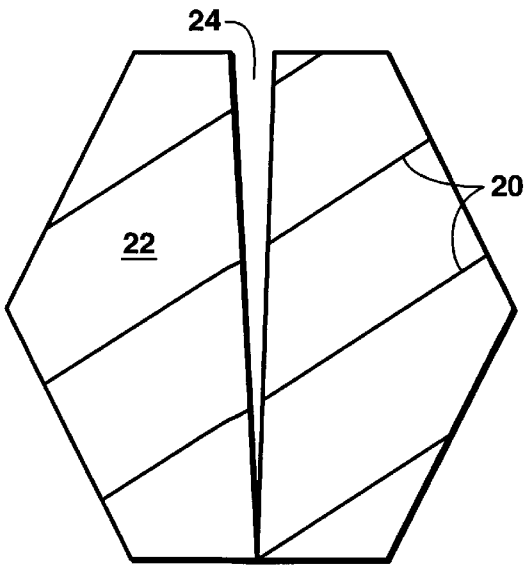
FIG. 2A (PRIOR ART)
FIG. 2A (Prior Art) is a schematic illustration showing a cleavage crack propagating through lath boundaries in a mixed microstructure of lower bainite and martensite in a conventional steel.

The TMCP practice thus described leads to a high value of Sv . Additionally, referring again to FIG. 2B, the micro-laminate microstructure produced during ausaging further increases the interfacial area by providing numerous high angle interfaces 29 between the laths 28 of lower bainite or lath martensite and the retained austenite film layers 30. Alternatively, referring now to FIG. 2C, in another embodiment of this invention the FGB microstructure produced during ausaging further increases the interfacial area by providing numerous high angle interfaces 27, in which the grain boundary, i.e., interface, separates two adjacent grains whose crystallographic orientations typically differ by more than about 15°, between the grains of bainitic ferrite 21 and particles of martensite and retained austenite 23 or between adjacent grains of bainitic ferrite 21. These micro-laminate and FGB configurations, as schematically illustrated in FIG. 2B and FIG. 2C, respectively, may be compared to the conventional bainite/martensite lath structure without the interlath retained austenite film layers, as illustrated in FIG. 2A. The conventional structure schematically illustrated in FIG. 2A is characterized by low angle boundaries 20 (i.e., boundaries that effectively behave as low angle grain boundaries (see Glossary)), e.g., between laths 22 of predominantly lower bainite and martensite; and thus, once a cleavage crack 24 is initiated, it can propagate through the lath boundaries 20 with little change in direction. In contrast, the micro-laminate microstructure in the steels of the current invention, as illustrated by FIG. 2B, leads to significant tortuosity in the crack path. This is because a crack 26 that is initiated in a lath 28, e.g., of lower bainite or martensite, for instance, will tend to change planes, i.e., change directions, at each high angle interface 29 with retained austenite film layers 30 due to the different orientation of cleavage and slip planes in the bainite and martensite constituents and the retained austenite phase. Additionally, the retained austenite film layers 30 provide blunting of an advancing crack 26 resulting in further energy absorption before the crack 26 propagates through the retained austenite film layers 30. The blunting occurs for several reasons. First, the FCC (as defined herein) retained austenite does not exhibit DBTT behavior and shear processes remain the only crack extension mechanism. Secondly, when the load/strain exceeds a certain higher value at the crack tip, the metastable austenite can undergo a stress or strain induced transformation to martensite leading to TRansformation Induced Plasticity (TRIP). TRIP can lead to significant energy absorption and lower the crack tip stress intensity. Finally, the lath martensite that forms from TRIP processes will have a different orientation of the cleavage and slip plane than that of the pre-existing bainite or lath martensite constituents making the crack path more tortuous. As illustrated by FIG. 2B, the net result is that the crack propagation resistance is significantly enhanced in the micro-laminate microstructure. Referring again to FIG. 2C, similar effects for crack deflection and tortuosity as discussed in the context of the micro-laminate microstructure in reference to FIG. 2B, as illustrated by crack 25 of FIG. 2C, are afforded by the FGB microstructure of the present invention.

The lower bainite/retained austenite or lath martensite/retained austenite interfaces in micro-laminate microstructures of steels according to the present invention and the bainitic ferrite grain/bainitic ferrite grain or bainitic ferrite grain/martensite and retained austenite particle interfaces in FGB microstructures of steels according to the present invention have excellent interfacial bond strengths and this forces crack deflection rather than interfacial debonding. The fine-grained lath martensite and fine-grained lower bainite occur as packets with high angle boundaries between the packets. Several packets are formed within a pancake. This provides a further degree of structural refinement leading to enhanced tortuosity for crack propagation through these packets within the pancake. This leads to substantial increase in Sv and consequently, lowering of DBTT.

Although the microstructural approaches described above are useful for lowering DBTT in the base steel plate, they are not fully effective for maintaining sufficiently low DBTT in the coarse grained regions of the weld HAZ. Thus, the present invention provides a method for maintaining sufficiently low DBTT in the coarse grained regions of the weld HAZ by utilizing intrinsic effects of alloying elements, as described in the following.

Leading ferritic cryogenic temperature steels are generally based on body-centered cubic (BCC) crystal lattice. While this crystal system offers the potential for providing high strengths at low cost, it suffers from a steep transition from ductile to brittle fracture behavior as the temperature is lowered. This can be fundamentally attributed to the strong sensitivity of the critical resolved shear stress (CRSS) (defined herein) to temperature in BCC systems, wherein CRSS rises steeply with a decrease in temperature thereby making the shear processes and consequently ductile fracture more difficult. On the other hand, the critical stress for brittle fracture processes such as cleavage is less sensitive to temperature. Therefore, as the temperature is lowered, cleavage becomes the favored fracture mode, leading to the onset of low energy brittle fracture. The CRSS is an intrinsic property of the steel and is sensitive to the ease with which dislocations can cross slip upon deformation; that is, a steel in which cross slip is easier will also have a low CRSS and hence a low DBTT. Some face-centered cubic (FCC) stabilizers such as Ni are known to promote cross slip, whereas BCC stabilizing alloying elements such as Si, Al, Mo, Nb and V discourage cross slip. In the present invention, content of FCC stabilizing alloying elements, such as Ni and Cu, is preferably optimized, taking into account cost considerations and the beneficial effect for lowering DBTT, with Ni alloying of preferably at least about 1.0 wt % and more preferably at least about 1.5 wt %; and the content of BCC stabilizing alloying elements in the steel is substantially minimized.

As a result of the intrinsic and microstructural toughening that results from the unique combination of chemistry and processing for steels according to this invention, the steels have excellent cryogenic temperature toughness in both the base plate in the transverse direction and the HAZ after welding. DBTTs in both the base plate and the HAZ after welding of these steels are lower than about −62° C. (−80° F.) and can be lower than about −107° C. (−160° F.).

(2) Tensile Strength Greater than about 830 MPa (120 ksi) and Thick Section Capability The strength of micro-laminate structure is primarily determined by the carbon content of the lath martensite and lower bainite. In the low alloy steels of the present invention, ausaging is carried out to produce retained austenite content in the steel plate of preferably up to about 10 volume percent, more preferably about 1 volume percent to about 10 volume percent, and even more preferably about 1 volume percent to about 5 volume percent. Ni and Mn additions of about 1.0 wt % to about 3.0 wt % and of up to about 2.5 wt % (preferably about 0.5 wt % to about 2.5 wt %), respectively, are especially preferred for providing the desired volume fraction of austenite and the delay in bainite start for ausaging. Copper additions of preferably about 0.1 wt % to about 1.0 wt % also contribute to the stabilization of austenite during ausaging.

In the present invention, the desired strength is obtained at a relatively low carbon content with the attendant advantages in weldability and excellent toughness in both the base steel and in the HAZ. A minimum of about 0.03 wt % C is preferred in the overall alloy for attaining tensile strength greater than about 830 MPa (120 ksi).

While alloying elements, other than C, in steels according to this invention are substantially inconsequential as regards the maximum attainable strength in the steel, these elements are desirable to provide the required thick section capability and strength for plate thickness equal to or greater than about 25 mm (1 inch) and for a range of cooling rates desired for processing flexibility. This is important as the actual cooling rate at the mid section of a thick plate is lower than that at the surface. The microstructure of the surface and center can thus be quite different unless the steel is designed to eliminate its sensitivity to the difference in cooling rate between the surface and the center of the plate. In this regard, Mn and Mo alloying additions, and especially the combined additions of Mn, Mo and B, are particularly effective. In the present invention, these additions are optimized for hardenability, weldability, low DBTT and cost considerations. As stated previously in this specification, from the point of view of lowering DBTT, it is essential that the total BCC alloying additions be kept to a minimum. The preferred chemistry targets and ranges are set to meet these and the other requirements of this invention.

In order to achieve the strength and thick section capability of the steels of this invention for plate thicknesses equal to or greater than about 25 mm, the $N_C$, a factor defined by the chemistry of the steel as shown below, is preferably in the range of about 2.5 to about 4.0 for steels with effective B additions, and is preferably in the range of about 3.0 to about 4.5 for steels with no added B. More preferably, for B containing steels according to this invention $N_C$ is preferably greater than about 2.8, even more preferably greater than about 3.0. For steels according to this invention without added B, $N_C$ preferably is greater than about 3.3 and even more preferably greater than about 3.5. Generally steels with $N_C$ in the high end of the preferred range, that is, greater than about 3.0 for steels with effective B additions and 3.5 for steels without added B, of this invention when processed according to the objects of this invention result in a predominantly micro-laminate microstructure comprising fine-grained lower bainite, fine-grained lath martensite, or mixtures thereof, and up to about 10 vol % retained austenite film layers. On the other hand, steels with $N_C$ in the lower end of the preferred range shown above tend to form a predominantly FGB microstructure.

$$N_C=12.0^\circ\ C.+Mn+0.8*Cr+0.15*(Ni+Cu)+0.4*Si+2.0*V+0.7*Nb+1.5*Mo,$$

where C, Mn, Cr, Ni, Cu, Si, V, Nb, Mo represent their respective wt % in the steel.

(3) Superior Weldability For Low Heat Input Welding

The steels of this invention are designed for superior weldability. The most important concern, especially with low heat input welding, is cold cracking or hydrogen cracking in the coarse grained HAZ. It has been found that for steels of the present invention, cold cracking susceptibility is critically affected by the carbon content and the type of HAZ microstructure, not by the hardness and carbon equivalent, which have been considered to be the critical parameters in the art. In order to avoid cold cracking when the steel is to be welded under no or low preheat (lower than about 100° C. (212° F.)) welding conditions, the preferred upper limit for carbon addition is about 0.1 wt %. As used herein, without limiting this invention in any aspect, "low heat input welding" means welding with arc energies of up to about 2.5 kilojoules per millimeter (kJ/mm) (7.6 kJ/inch).

Lower bainite or auto-tempered lath martensite microstructures offer superior resistance to cold cracking. Other alloying elements in the steels of this invention are carefully balanced, commensurate with the hardenability and strength requirements, to ensure the formation of these desirable microstructures in the coarse grained HAZ.

Role of Alloying Elements in the Steel Slab

The role of the various alloying elements and the preferred limits on their concentrations for the present invention are given below:

Carbon (C) is one of the most effective strengthening elements in steel. It also combines with the strong carbide formers in the steel such as Ti, Nb, and V to provide grain growth inhibition and precipitation strengthening. Carbon also enhances hardenability, i.e., the ability to form harder and stronger microstructures in the steel during cooling. If the carbon content is less than about 0.03 wt %, it is generally not sufficient to induce the desired strengthening, viz., greater than about 830 MPa (120 ksi) tensile strength, in the steel. If the carbon content is greater than about 0.12 wt %, generally the steel is susceptible to cold cracking during welding and the toughness is reduced in the steel plate and its HAZ on welding. Carbon content in the range of about 0.03 wt % to about 0.12 wt % is preferred to produce the desired HAZ microstructures, viz., auto-tempered lath martensite and lower bainite. Even more preferably, the upper limit for carbon content is about 0.07 wt %.

Manganese (Mn) is a matrix strengthener in steels and also contributes strongly to the hardenability. Mn is a key, inexpensive alloying addition to promote micro-laminate microstructure and to prevent excessive FGB in thick section plates which can lead to reduction in strength. Mn addition is useful for obtaining the desired bainite transformation delay time needed for ausaging. A minimum amount of 0.5 wt % Mn is preferred for achieving the desired high strength in plate thickness exceeding about 25 mm (1 inch), and a minimum of at least about 1.0 wt % Mn is even more preferred. Mn additions of at least about 1.5 wt % are yet more preferred for high plate strength and processing flexibility as Mn has a dramatic effect on hardenability at low C levels of less than about 0.07 wt %. However, too much Mn can be harmful to toughness, so an upper limit of about 2.5 wt % Mn is preferred in the present invention. This upper limit is also preferred to substantially minimize centerline segregation that tends to occur in high Mn and continuously cast steels and the attendant poor microstructure and toughness properties at the center of the plate. More preferably, the upper limit for Mn content is about 2.1 wt %. If nickel content is increased above about 3 wt %, the desired high strength can be achieved at low additions of manganese. Therefore, in a broad sense, up to about 2.5 wt % manganese is preferred.

Silicon (Si) is added to steel for deoxidation purposes and a minimum of about 0.01 wt % is preferred for this purpose. However, Si is a strong BCC stabilizer and thus raises DBTT and also has an adverse effect on the toughness. For these reasons, when Si is added, an upper limit of about 0.5 wt % Si is preferred. More preferably, the upper limit for Si content is about 0.1 wt %. Silicon is not always necessary for deoxidation since aluminum or titanium can perform the same function.

Niobium (Nb) is added to promote grain refinement of the rolled microstructure of the steel, which improves both the strength and toughness. Niobium carbide precipitation during hot rolling serves to retard recrystallization and to inhibit grain growth, thereby providing a means of austenite grain refinement. For these reasons, at least about 0.02 wt % Nb is preferred. However, Nb is a strong BCC stabilizer and thus raises DBTT. Too much Nb can be harmful to the weldability and HAZ toughness, so a maximum of about 0.1 wt % is preferred. More preferably, the upper limit for Nb content is about 0.05 wt %.

Titanium (Ti), when added in a small amount, is effective in forming fine titanium nitride (TiN) particles which refine the grain size in both the rolled structure and the HAZ of the steel. Thus, the toughness of the steel is improved. Ti is added in such an amount that the weight ratio of Ti/N is preferably about 3.4. Ti is a strong BCC stabilizer and thus raises DBTT. Excessive Ti tends to deteriorate the toughness of the steel by forming coarser TiN or titanium carbide (TiC) particles. A Ti content below about 0.008 wt % generally can not provide sufficiently fine grain size or tie up the N in the steel as TiN while more than about 0.03 wt % can cause deterioration in toughness. More preferably, the steel contains at least about 0.01 wt % Ti and no more than about 0.02 wt % Ti.

Aluminum (Al) is added to the steels of this invention for the purpose of deoxidation. At least about 0.001 wt % Al is preferred for this purpose, and at least about 0.005 wt % Al is even more preferred. Al ties up nitrogen dissolved in the HAZ. However, Al is a strong BCC stabilizer and thus raises DBTT. If the Al content is too high, i.e., above about 0.05 wt %, there is a tendency to form aluminum oxide ($Al_2O_3$) type inclusions, which tend to be harmful to the toughness of the steel and its HAZ. Even more preferably, the upper limit for Al content is about 0.03 wt %.

Molybdenum (Mo) increases the hardenability of steel on direct quenching, especially in combination with boron and niobium. Mo is also desirable for promoting ausaging. For these reasons, at least about 0.1 wt % Mo is preferred, and at least about 0.2 wt % Mo is even more preferred. However, Mo is a strong BCC stabilizer and thus raises DBTT. Excessive Mo helps to cause cold cracking on welding, and also tends to deteriorate the toughness of the steel and HAZ, so a maximum of about 0.8 wt % Mo is preferred, and a maximum of about 0.4 wt % Mo is even more preferred. Therefore, in a broad sense, up to about 0.8 wt % Mo is preferred.

Chromium (Cr) tends to increase the hardenability of steel on direct quenching. In small additions, Cr leads to stabilization of austenite. Cr also improves corrosion resistance and hydrogen induced cracking (HIC) resistance. Similar to Mo, excessive Cr tends to cause cold cracking in weldments, and tends to deteriorate the toughness of the steel and its HAZ, so when Cr is added a maximum of about 1.0 wt % Cr is preferred. More preferably, when Cr is added the Cr content is about 0.2 wt % to about 0.6 wt %.

Nickel (Ni) is an important alloying addition to the steels of the present invention to obtain the desired DBTT, especially in the HAZ. It is one of the strongest FCC stabilizers in steel. Ni addition to the steel enhances the cross slip and thereby lowers DBTT. Although not to the same degree as Mn and Mo additions, Ni addition to the steel also promotes hardenability and therefore through-thickness uniformity in microstructure and properties, such as strength and toughness, in thick sections. Ni addition is also useful for obtaining the desired bainite transformation delay time needed for ausaging. For achieving the desired DBTT in the weld HAZ, the minimum Ni content is preferably about 1.0 wt %, more preferably about 1.5 wt %, even more preferably 2.0 wt %. Since Ni is an expensive alloying element, the Ni content of the steel is preferably less than about 3.0 wt %, more preferably less than about 2.5 wt %, even more preferably less than about 2.0 wt %, and even more preferably less than about 1.8 wt %, to substantially minimize cost of the steel.

Copper (Cu) is a desirable alloying addition to stabilize austenite to produce the micro-laminate microstructure. Preferably at least about 0.1 wt %, more preferably at least about 0.2 wt %, of Cu is added for this purpose. Cu is also an FCC stabilizer in steel and can contribute to lowering of DBTT in small amounts. Cu is also beneficial for corrosion and HIC resistance. At higher amounts, Cu induces excessive precipitation hardening via $\epsilon$-copper precipitates. This precipitation, if not properly controlled, can lower the toughness and raise the DBTT both in the base plate and HAZ. Higher Cu can also cause embrittlement during slab casting and hot rolling, requiring co-additions of Ni for mitigation.

For the above reasons, an upper limit of about 1.0 wt % Cu is preferred, and an upper limit of about 0.5 wt % is even more preferred. Therefore, in a broad sense, up to about 1.0 wt % Cu is preferred.

Boron (B) in small quantities can greatly increase the hardenability of steel very inexpensively and promote the formation of steel microstructures of lower bainite and lath martensite microstructures even in thick (≧25 mm) section plates, by suppressing the formation of ferrite, upper bainite and FGB, both in the base plate and the coarse grained HAZ. Generally, at least about 0.0004 wt % B is needed for this purpose. When boron is added to steels of this invention, from about 0.0006 wt % to about 0.0020 wt % is preferred, and an upper limit of about 0.0015 wt % is even more preferred. However, boron may not be a required addition if other alloying in the steel provides adequate hardenability and the desired microstructure.

DESCRIPTION AND EXAMPLES OF STEELS ACCORDING TO THIS INVENTION

A 300 lb. heat of each chemical alloy shown in Table II was vacuum induction melted (VIM), cast into either round ingots or slabs of at least 130 mm thickness and subsequently forged or machined to 130 mm by 130 mm by 200 mm long slabs. One of the round VIM ingots was subsequently vacuum arc remelted (VAR) into a round ingot and forged into a slab. The slabs were TMCP processed in a laboratory mill as described below. Table II shows the chemical composition of the alloys used for the TMCP processing.

TABLE II

| | Alloy | | | | |
|---|---|---|---|---|---|
| Melting | A1 VIM | A2 VIM | A3 VIM + VAR | A4 VIM | A5 VIM |
| C (wt %) | 0.063 | 0.060 | 0.053 | 0.040 | 0.037 |
| Mn (wt %) | 1.59 | 1.49 | 1.72 | 1.69 | 1.65 |
| Ni (wt %) | 2.02 | 2.99 | 2.07 | 3.30 | 2.00 |
| Mo (wt %) | 0.21 | 0.21 | 0.20 | 0.21 | 0.20 |
| Cu (wt %) | 0.30 | 0.30 | 0.24 | 0.30 | 0.31 |
| Nb (wt %) | 0.030 | 0.032 | 0.029 | 0.033 | 0.031 |
| Si (wt %) | 0.09 | 0.09 | 0.12 | 0.08 | 0.09 |
| Ti (wt %) | 0.012 | 0.013 | 0.009 | 0.013 | 0.010 |
| Al (wt %) | 0.011 | 0.015 | 0.001 | 0.015 | 0.008 |
| B (ppm) | 10 | 10 | 13 | 11 | 9 |
| O (ppm) | 15 | 18 | 8 | 15 | 14 |
| S (ppm) | 18 | 16 | 16 | 17 | 18 |
| N (ppm) | 16 | 20 | 21 | 22 | 23 |
| P (ppm) | 20 | 20 | 20 | 20 | 20 |
| Cr (wt %) | — | — | — | 0.05 | 0.19 |
| $N_c$ | 3.07 | 3.08 | 3.07 | 3.11 | 2.94 |

The slabs were first reheated in a temperature range from about 1000° C. to about 1050° C. (1832° F. to about 1922° F.) for about 1 hour prior to the start of rolling according to the TMCP schedules shown in Table III:

TABLE III

| Thickness (mm) | | Temperature, ° C. | | | | |
|---|---|---|---|---|---|---|
| Pass | After Pass | A1 | A2 | A3 | A4 | A5 |
| 0 | 130 | 1007 | 1005 | 1000 | 999 | 1051 |
| 1 | 117 | 973 | 973 | 971 | 973 | 973 |
| 2 | 100 | 963 | 962 | 961 | 961 | 961 |
| | | Delay, turn piece on the side | | | | |
| 3 | 85 | 870 | 868 | 868 | 868 | 867 |

TABLE III-continued

| Thickness (mm) | | Temperature, ° C. | | | | |
|---|---|---|---|---|---|---|
| Pass | After Pass | A1 | A2 | A3 | A4 | A5 |
| 4 | 72 | 860 | 855 | 856 | 858 | 857 |
| 5 | 61 | 850 | 848 | 847 | 847 | 833 |
| 6 | 51 | 840 | 837 | 837 | 836 | 822 |
| 7 | 43 | 834 | 827 | 827 | 828 | 810 |
| 8 | 36 | 820 | 815 | 804 | 816 | 791 |
| 9 | 30 | 810 | 806 | 788 | 806 | 770 |
| 10 | 25 | 796 | 794 | 770 | 796 | 752 |
| QST (° C.) | | 217 | 187 | 177 | 189 | 187 |
| Cooling rate to QST (° C./s) | | 29 | 28 | 25 | 28 | 25 |
| Cooling from QST to Ambient | | ------- Ambient Air Cool -------- | | | | |
| Pancake thickness, microns (measured at ¼ of plate thickness) | | 2.41 | 3.10 | 2.46 | 2.88 | 2.7 |

Following the preferred TMCP processing shown in Table III, the microstructure of plate samples A1 through A4 is predominantly fine-grained lath martensite forming a micro-laminate microstructure with up to about 2.5 vol % retained austenite layers at martensite lath boundaries. The other minor constituents of the microstructure are variable among these samples, A1 through A4, but included less than about 10 vol % fine-grained lower bainite and from about 10 to about 25 vol % FGB.

Figure 4:
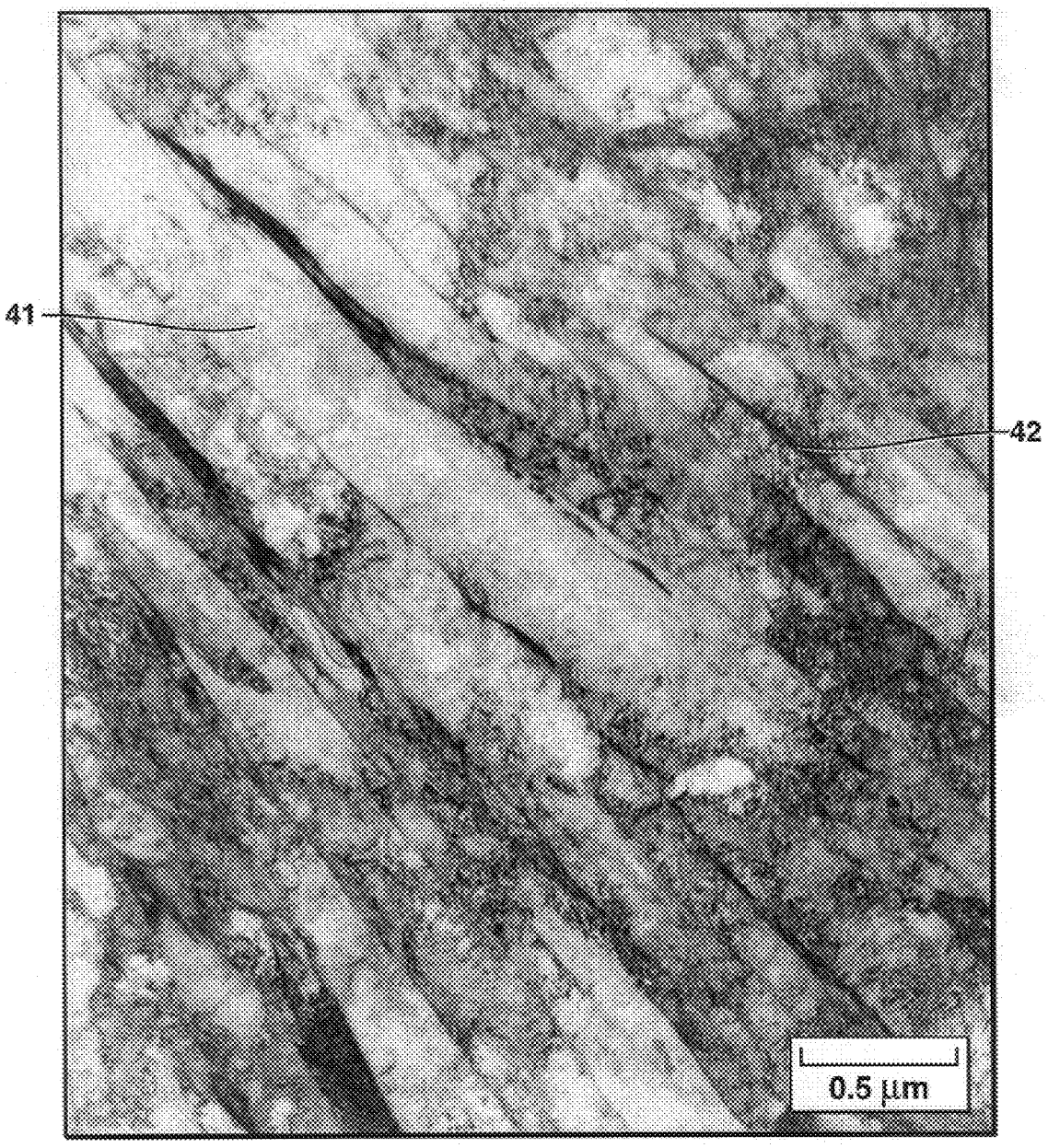
FIG. 4 is a transmission electron micrograph revealing the micro-laminate microstructure in a steel plate identified as A3 in Table II herein.

The transverse tensile strength and DBTT of the plates of Tables II and III are summarized in Table IV. The tensile strengths and DBTTs summarized in Table IV were measured in the transverse direction, i.e., a direction that is in the plane of rolling but perpendicular to the plate rolling direction, wherein the long dimensions of the tensile test specimen and the Charpy V-Notch test bar were substantially parallel to this direction with the crack propagation substantially perpendicular to this direction. A significant advantage of this invention is the ability to obtain the DBTT values summarized in Table IV in the transverse direction in the manner described in the preceding sentence. Referring now to FIG. 4, a transmission electron micrograph revealing the microlaminate microstructure in a steel plate identified as A3 in Table II herein is provided. The microstructure illustrated in FIG. 4 comprises predominantly lath martensite 41 with thin retained austenite films 42 at most of the martensite lath boundaries. FIG. 4 represents the predominantly micro-laminate microstructure of the A1 through A4 steels of the present invention tabulated in Tables II through IV. This microstructure provides high strengths (transverse) of about 1000 MPa (145 ksi) and higher with excellent DBTT in the transverse direction, as shown in Table IV.

TABLE IV

| Alloy | A1 | A2 | A3 | A4 | A5 |
|---|---|---|---|---|---|
| Tensile Strength, MPa (ksi) | 1000 (145) | 1060 (154) | 1115 (162) | 1035 (150) | 915 (133) |
| DBTT, ° C. (° F.) | −117 (−179) | −133 (−207) | −164 (−263) | −140 (−220) | −111 (−168) |

Without thereby limiting this invention, the DBTT values given in TABLE IV correspond to the 50% energy transition temperature experimentally determined from Charpy V-Notch impact testing according to standard procedures as set forth in ASTM specification E-23, as will be familiar to those skilled in the art. The Charpy V-Notch impact test is a well-known test for measuring the toughness of steels.

Figure 5:
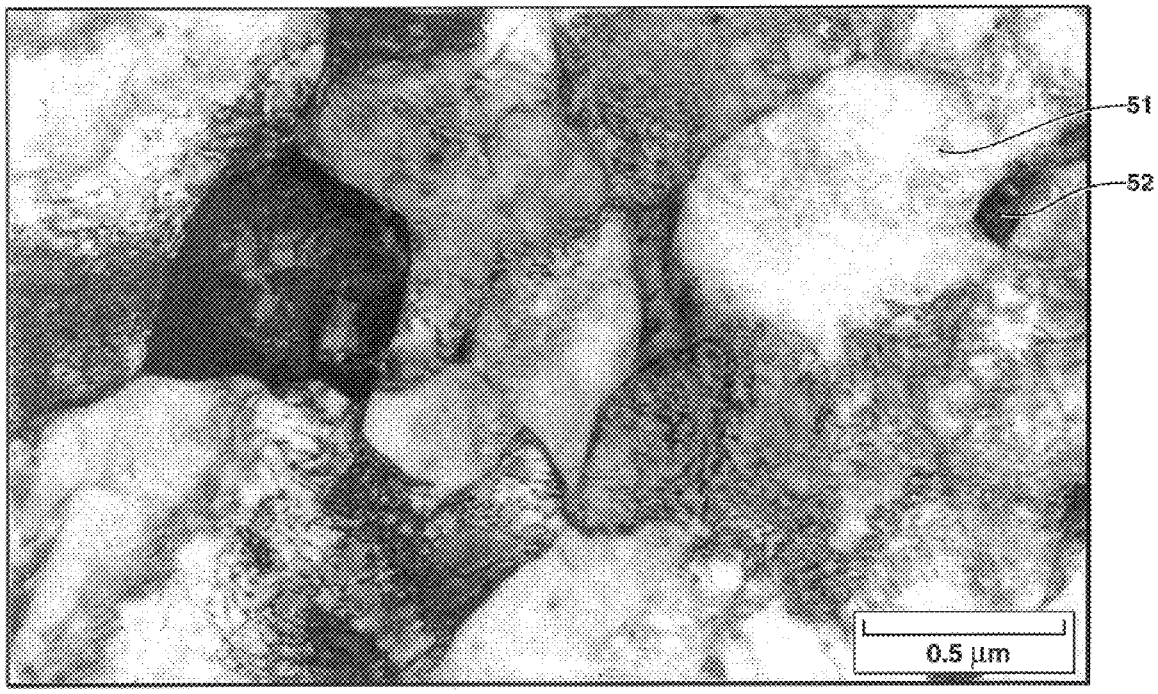
FIG. 5 is a transmission electron micrograph revealing the FGB microstructure in a steel plate identified as A5 in Table II herein.

Referring to Table II, steel plate A5, with a lower $N_C$ than plates A1–A4, revealed a predominantly FGB microstructure, which explains the lower strength seen in this plate sample. About 40 vol % fine-grained lath martensite is seen in this plate. Referring now to FIG. 5, a transmission electron micrograph (TEM) revealing the FGB microstructure in the steel plate identified as A5 in Table II is provided. The FGB is an aggregate of bainitic ferrite 51 (major phase) and martensite/retained austenite particles 52 (minor). In somewhat greater detail, FIG. 5 presents a TEM micrograph revealing the equiaxed, FGB microstructure comprising bainitic ferrite 51 and martensite/retained austenite particles 52 that are present in certain embodiments of steels according to this invention.

(4) Preferred Steel Composition When Post Weld Heat Treatment (PWHT) Is Required PWHT is normally carried out at high temperatures, e.g., greater than about 540° C. (1000° F.). The thermal exposure from PWHT can lead to a loss of strength in the base plate as well as in the weld HAZ due to softening of the microstructure associated with the recovery of substructure (i.e., loss of processing benefits) and coarsening of cementite particles. To overcome this, the base steel chemistry as described above is preferably modified by adding a small amount of vanadium. Vanadium is added to give precipitation strengthening by forming fine vanadium carbide (VC) particles in the base steel and HAZ upon PWHT. This strengthening is designed to offset substantially the strength loss upon PWHT. However, excessive VC strengthening is to be avoided as it can degrade the toughness and raise DBTT both in the base plate and its HAZ. In the present invention an upper limit of about 0.1 wt % is preferred for V for these reasons. The lower limit is preferably about 0.02 wt %. More preferably, about 0.03 wt % to about 0.05 wt % V is added to the steel.

This step-out combination of properties in the steels of the present invention provides a low cost enabling technology for certain cryogenic temperature operations, for example, storage and transport of natural gas at low temperatures. These new steels can provide significant material cost savings for cryogenic temperature applications over the current state-of-the-art commercial steels, which generally require far higher nickel contents (up to about 9 wt %) and are of much lower strengths (less than about 830 MPa (120 ksi)). Chemistry and microstructure design are used to lower DBTT and provide thick section capability for section thicknesses exceeding about 25 mm (1 inch). These new steels preferably have nickel contents lower than about 3.5 wt %, tensile strength greater than about 830 MPa (120 ksi), preferably greater than about 860 MPa (125 ksi), and more preferably greater than about 900 MPa (130 ksi), and even more preferably greater than about 1000 MPa (145 ksi); ductile to brittle transition temperatures (DBTTs) for base metal in the transverse direction below about −62° C. (−80° F.), preferably below about −73° C (−80° F.), more preferably below about −100° C. (−150° F.), even more preferably below about −123° C. (−190° F.); and offer excellent toughness at DBTT. These new steels can have a tensile strength of greater than about 930 MPa (135 ksi), or greater than about 965 MPa (140 ksi), or greater than about 1000 MPa (145 ksi). Nickel content of these steel can be increased above about 3 wt % if desired to enhance performance after welding. Each 1 wt % addition of nickel is expected to lower the DBTT of the steel by about 10° C. (18° F.). Nickel content is preferably less than 9 wt %, more preferably less than about 6 wt %. Nickel content is preferably minimized in order to minimize cost of the steel.

While the foregoing invention has been described in terms of one or more preferred embodiments, it should be understood that other modifications may be made without departing from the scope of the invention, which is set forth in the following claims.

Glossary of terms:

| | |
|---|---|
| $Ac_1$ transformation temperature: | the temperature at which austenite begins to form during heating; |
| $Ac_3$ transformation temperature: | the temperature at which transformation of ferrite to austenite is completed during heating; |
| AF: | acicular ferrite; |
| $Al_2O_3$: | aluminum oxide; |
| $Ar_3$ transformation temperature: | the temperature at which austenite begins to transform to ferrite during cooling; |
| BCC: | body-centered cubic; |
| cementite: | iron-rich carbide; |
| cooling rate: | cooling rate at the center, or substantially at the center, of the plate thickness; |
| CRSS (critical resolved shear stress): | an intrinsic property of a steel, sensitive to the ease with which dislocations can cross slip upon deformation, that is, a steel in which cross slip is easier will also have a low CRSS and hence a low DBTT; |
| cryogenic temperature: | any temperature lower than about −40° C. (−40° F.); |
| DBTT (Ductile to Brittle Transition Temperature): | delineates the two fracture regimes in structural steels; at temperatures below the DBTT, failure tends to occur by low energy cleavage (brittle) fracture, while at temperatures above the DBTT, failure tends to occur by high energy ductile fracture; |
| DF: | deformed ferrite; |
| DUB: | degenerate upper bainite; |
| effective grain size: | as used in describing this invention, refers to mean austenite pancake thickness upon completion of rolling in the TMCP according to this invention and to mean packet width or mean grain size upon completion of transformation of the austenite pancakes to packets of micro-laminate structure or FGB, respectively; |
| FCC: | face-centered cubic; |
| FGB (fine granular bainite): | as used in describing this invention, an aggregate comprising bainitic ferrite as a major constituent and particles of mixtures of martensite and retained austenite as minor constituents; |
| grain: | an individual crystal in a polycrystalline material; |
| grain boundary: | a narrow zone in a metal corresponding to the transition from one crystallographic orientation to another, thus separating one grain from another; |
| HAZ: | heat affected zone; |
| HIC: | hydrogen induced cracking; |
| high angle boundary or interface: | boundary or interface that effectively behaves as a high angle grain boundary, i.e., tends to deflect a propagating crack or fracture and, thus, induces tortuosity in a fracture path; |
| high angle grain boundary: | a grain boundary that separates two adjacent grains whose crystallographic orientations differ by more than about 8°; |
| HSLA: | high strength, low alloy; |
| intercritically reheated: | heated (or reheated) to a temperature of from about the $Ac_1$ transformation temperature to about the $Ac_3$ transformation temperature; |
| low alloy steel: | a steel containing iron and less than about 10 wt % total alloy additives; |

-continued

| Glossary of terms: | |
|---|---|
| low angle grain boundary: | a grain boundary that separates two adjacent grains whose crystallographic orientations differ by less than about 8°; |
| low heat input welding; | welding with arc energies of up to about 2.5 kJ/mm (7.6 kJ/inch); |
| MA: | martensite-austenite; |
| major: | as used in describing the present invention, means at least about 50 volume percent; |
| minor: | as used in describing the present invention, means less than about 50 volume percent; |
| $M_s$ transformation temperature: | the temperature at which transformation of austenite to martensite starts during cooling; |
| Nc: | a factor defined by the chemistry of the steel as $\{N_c = 12.0*C + Mn + 0.8*Cr + 0.15*(Ni + Cu) + 0.4*Si + 2.0*V + 0.7*Nb + 1.5*Mo\}$, where C, Mn, Cr, Ni, Cu, Si, V, Nb, Mo represent their respective wt % in the steel; |
| PF | polygonal ferrite; |
| predominantly/predominant: | as used in describing the present invention, means at least about 50 volume percent; |
| prior austenite grain size: | average austenite grain size in a hot-rolled steel plate prior to rolling in the temperature range in which austenite does not recrystallize; |
| quenching: | as used in describing the present invention, accelerated cooling by any means whereby a fluid selected for its tendency to increase the cooling rate of the steel is utilized, as opposed to air cooling; |
| Quench Stop Temperature (QST): | the highest, or substantially the highest, temperature reached at the surface of the plate, after quenching is stopped, because of heat transmitted from the mid-thickness of the plate; |
| RA: | retained austenite; |
| slab: | a piece of steel having any dimensions; |
| Sv: | total interfacial area of the high angle boundaries per unit volume in steel plate; |
| TEM: | transmission electron micrograph; |
| tensile strength: | in tensile testing, the ratio of maximum load to original cross-sectional area; |
| thick section capability: | the ability to provide substantially the desired microstructure and properties (e.g., strength and toughness), particularly in thicknesses equal to or greater than about 25 mm (1 inch); |
| through-thickness direction: | a direction that is orthogonal to the plane of rolling; |
| TiC: | titanium carbide; |
| TiN: | titanium nitride; |
| $T_{nr}$ temperature: | the temperature below which austenite does not recrystallize; |
| TMCP: | thermo-mechanical controlled rolling processing; |
| transverse direction: | a direction that is in the plane of rolling but perpendicular to the plate rolling direction; |
| UB: | upper bainite; |
| VAR: | vacuum arc remelted; and |
| VIM: | vacuum induction melted. |

We claim:

1. A method for preparing a steel plate having a microstructure comprising (i) predominantly fine-grained lower bainite, fine-grained lath martensite, fine granular bainite (FGB), or mixtures thereof, and (ii) >0 to about 10 vol % retained austenite, said method comprising the steps of:

(a) heating a steel slab to a reheating temperature sufficiently high to (i) substantially homogenize said steel slab, (ii) dissolve substantially all carbides and carbonitrides of niobium and vanadium in said steel slab, and (iii) establish fine initial austenite grains in said steel slab;

(b) reducing said steel slab to form steel plate in one or more hot rolling passes in a first temperature range in which austenite recrystallizes;

(c) further reducing said steel plate in one or more hot rolling passes in a second temperature range below about the $T_{nr}$ temperature and above about the $Ar_3$ transformation temperature;

(d) quenching said steel plate at a cooling rate of at least about 10° C. per second (18° F./sec) to a Quench Stop Temperature below about 550° C. (1022° F.); and (e) stopping said quenching, said steps being performed so as to facilitate transformation of said microstructure of said steel plate to (i) predominantly fine-grained lower bainite, fine-grained lath martensite, fine granular bainite (FGB), or mixtures thereof, and (ii) >0 to about 10 vol % retained austenite.

2. The method of claim 1 wherein step (e) is replaced with the following:

(e) stopping said quenching, said steps being performed so as to facilitate transformation of said microstructure of said steel plate to a predominantly micro-laminate microstructure comprising fine-grained lath martensite, fine-grained lower bainite, or mixtures thereof, and >0 to about 10 vol % retained austenite film layers.

3. The method of claim 1 wherein step (e) is replaced with the following:

(e) stopping said quenching, said steps being performed so as to facilitate transformation of said microstructure of said steel plate to a predominantly fine granular bainite (FGB).

4. The method of claim 1 wherein said reheating temperature of step (a) is between about 955° C. and about 1100° C. (1750° F.–2010° F.).

5. The method of claim 1 wherein said fine initial austenite grains of step (a) have a grain size of less than about 120 microns.

6. The method of claim 1 wherein a reduction in thickness of said steel slab of about 30% to about 70% occurs in step (b).

7. The method of claim 1 wherein a reduction in thickness of said steel plate of about 40% to about 80% occurs in step (c).

8. The method of claim 1 further comprising the step of allowing said steel plate to air cool to ambient temperature from said Quench Stop Temperature.

9. The method of claim 1 further comprising the step of holding said steel plate substantially isothermally at said Quench Stop Temperature for up to about 5 minutes.

10. The method of claim 1 further comprising the step of slow-cooling said steel plate at said Quench Stop Temperature at a rate lower than about 1.0° C. per second (1.8° F./sec) for up to about 5 minutes.

11. The method of claim 1 wherein said steel slab of step (a) comprises iron and the following alloying elements in the weight percents indicated:

about 0.03% to about 0.12% C, at least about 1% to about less than 9% Ni, up to about 1.0% Cu, up to about 0.8% Mo, about 0.01% to about 0.1% Nb, about 0.008% to about 0.03% Ti, up to 0.05% Al, and about 0.001% to about 0.005% N.

12. The method of claim 11 wherein said steel slab comprises less than about 6 wt % Ni.

13. The method of claim 11 wherein said steel slab comprises less than about 3 wt % Ni and additionally comprises up to about 2.5 wt % Mn.

14. The method of claim 11 wherein said steel slab further comprises at least one additive selected from the group consisting of (i) up to about 1.0 wt % Cr, (ii) up to about 0.5 wt % Si, (iii) about 0.02 wt % to about 0.10 wt % V, (iv) up to about 2.5 wt % Mn, and (v) up to about 0.0020 wt % B.

15. The method of claim 11 wherein said steel slab further comprises about 0.0004 wt % to about 0.0020 wt % B.

16. The method of claim 1 wherein, after step (e), said steel plate has a DBTT lower than about −62° C. (−80° F.) in both said base plate and its HAZ and has a tensile strength greater than about 830 MPa (120 ksi).

17. A steel plate having a microstructure comprising (i) predominantly fine-grained lower bainite, fine-grained lath martensite, fine granular bainite (FGB), or mixtures thereof, and (ii) >0 to about 10 vol % retained austenite, having a tensile strength greater than about 830 MPa (120 ksi), and having a DBTT of lower than about −62° C. (−80° F.) in both said steel plate and its HAZ, and wherein said steel plate is produced from a reheated steel slab comprising iron and the following alloying elements in the weight percents indicated:

about 0.03% to about 0.12% C, at least about 1% to about less than 9% Ni, up to about 1.0% Cu, up to about 0.8% Mo, about 0.01% to about 0.1% Nb, about 0.008% to about 0.03% Ti, up to about 0.05% Al, and about 0.001% to about 0.005% N.

18. The steel plate of claim 17 wherein said steel slab comprises less than about 6 wt % Ni.

19. The steel plate of claim 17 wherein said steel slab comprises less than about 3 wt % Ni and additionally comprises up to about 2.5 wt % Mn.

20. The steel plate of claim 17 further comprising at least one additive selected from the group consisting of (i) up to about 1.0 wt % Cr, (ii) up to about 0.5 wt % Si, (iii) about 0.02 wt % to about 0.10 wt % V, (iv) up to about 2.5 wt % Mn, and (v) from about 0.0004 to 0.0020 wt % B.

21. The steel plate of claim 17 further comprising about 0.0004 wt % to about 0.0020 wt % B.

22. The steel plate of claim 17 having a predominantly micro-laminate microstructure comprising laths of fine-grained lath martensite, laths of fine-grained lower bainite, or mixtures thereof, and up to about 10 vol % retained austenite film layers.

23. The steel plate of claim 22, wherein said micro-laminate microstructure is optimized to substantially maximize crack path tortuosity by thermo-mechanical controlled rolling processing that provides a plurality of high angle interfaces between said laths of fine-grained martensite and fine-grained lower bainite and said retained austenite film layers.

24. The steel plate of claim 17 having a microstructure of predominantly fine granular bainite (FGB), wherein said fine granular bainite (FGB) comprises bainitic ferrite grains and particles of mixtures of martensite and retained austenite.

25. The steel plate of claim 24, wherein said microstructure is optimized to substantially maximize crack path tortuosity by thermo-mechanical controlled rolling processing that provides a plurality of high angle interfaces between said bainitic ferrite grains and between said bainitic ferrite grains and said particles of mixtures of martensite and retained austenite.

26. A method for enhancing the crack propagation resistance of a steel plate, said method comprising processing said steel plate to produce a predominantly micro-laminate microstructure comprising laths of fine-grained lath martensite, laths of fine-grained lower bainite, or mixtures thereof, and >0 to about 10 vol % retained austenite film layers, said micro-laminate microstructure being optimized to substantially maximize crack path tortuosity by thermo-mechanical controlled rolling processing that provides a plurality of high angle interfaces between said laths of fine-grained martensite and fine-grained lower bainite and said retained austenite film layers.

27. The method of claim 26 wherein said crack propagation resistance of said steel plate is further enhanced, and crack propagation resistance of the HAZ of said steel plate when welded is enhanced, by adding at least about 1.0 to about less than 9 wt % Ni and at least about 0.1 to about 1.0 wt % Cu, and by substantially minimizing addition of BCC stabilizing elements.

28. A method for enhancing the crack propagation resistance of a steel plate, said method comprising processing said steel plate to produce a microstructure of predominantly fine granular bainite (FGB), wherein said fine granular bainite (FGB) comprises bainitic ferrite grains and particles of mixtures of martensite and retained austenite, and wherein said microstructure is optimized to substantially maximize crack path tortuosity by thermo-mechanical controlled rolling processing that provides a plurality of high angle interfaces between said bainitic ferrite grains and between said bainitic ferrite grains and said particles of mixtures of martensite and retained austenite.

29. The method of claim 28 wherein said crack propagation resistance of said steel plate is further enhanced, and crack propagation resistance of the HAZ of said steel plate when welded is enhanced, by adding at least about 1.0 to about less than wt % Ni and at least about 0.1 to about 1.0 wt % Cu, and by substantially minimizing addition of BCC stabilizing elements.

* * * * *